US010930484B2

(12) United States Patent
Kobayashi et al.

(10) Patent No.: US 10,930,484 B2
(45) Date of Patent: Feb. 23, 2021

(54) ION DETECTOR

(71) Applicant: HAMAMATSU PHOTONICS K.K., Hamamatsu (JP)

(72) Inventors: Hiroshi Kobayashi, Hamamatsu (JP); Shinya Hattori, Hamamatsu (JP); Sayaka Takatsuka, Hamamatsu (JP)

(73) Assignee: HAMAMATSU PHOTONICS K.K., Hamamatsu (JP)

( * ) Notice: Subject to any disclaimer, the term of this patent is extended or adjusted under 35 U.S.C. 154(b) by 0 days.

(21) Appl. No.: 16/834,097

(22) Filed: Mar. 30, 2020

(65) Prior Publication Data

US 2020/0312645 A1 Oct. 1, 2020

(30) Foreign Application Priority Data

Apr. 1, 2019 (JP) ..... JP2019-069962

(51) Int. Cl.
*H01J 49/02* (2006.01)
*H01J 49/06* (2006.01)

(52) U.S. Cl.
CPC ..... *H01J 49/022* (2013.01); *H01J 49/025* (2013.01); *H01J 49/067* (2013.01)

(58) Field of Classification Search
CPC ..... H01J 49/02; H01J 49/022; H01J 49/025; H01J 49/06; G01T 1/20; G01T 1/24; G01T 1/248
See application file for complete search history.

(56) References Cited

U.S. PATENT DOCUMENTS

| | | | | |
|---|---|---|---|---|
| 9,899,201 | B1 * | 2/2018 | Park | H01J 49/08 |
| 2003/0111597 | A1 * | 6/2003 | Gonin | H01J 49/025 250/287 |
| 2004/0173742 | A1 * | 9/2004 | Bateman | H01J 43/246 250/288 |
| 2004/0227070 | A1 * | 11/2004 | Bateman | H01J 49/025 250/287 |
| 2008/0290267 | A1 * | 11/2008 | Hayashi | H01J 49/025 250/282 |
| 2014/0097340 | A1 * | 4/2014 | Suzuki | H01J 43/246 250/287 |

FOREIGN PATENT DOCUMENTS

| | | | | |
|---|---|---|---|---|
| JP | H7-073847 | A | 3/1995 | |
| JP | 2004-533611 | A | 11/2004 | |
| JP | 2017-016918 | A | 1/2017 | |
| JP | 2017016918 | A * | 1/2017 | G01T 1/28 |
| WO | WO-02/091425 | A2 | 11/2002 | |

* cited by examiner

*Primary Examiner* — David E Smith
(74) *Attorney, Agent, or Firm* — Faegre Drinker Biddle & Reath LLP

(57) ABSTRACT

To provide an ion detector having an electron lens structure that enables expansion of an effective region of an MCP for capturing ions.
The ion detector comprises an MCP unit including an MCP and a first focus electrode, a signal output device including an electron detector surface, and a reset unit disposed between the MCP unit and the signal output device. The reset unit includes a reset element and a second focus electrode. The reset element includes a second input surface and a second output surface opposing each other. On the second output surface, the reset element resets variations in incident angle and velocity of electrons on the second input surface.

8 Claims, 13 Drawing Sheets

ION DETECTOR

TECHNICAL FIELD

The present invention relates to an ion detector.

BACKGROUND

Known examples of an ion detector applicable to a mass spectrometry or the like include one provided with an electron multiplier, one provided with a microchannel plate (hereinafter referred to as "MCP"), and one provided with a combination of an MCP and an electron impact diode such as an avalanche diode (hereinafter referred to as "AD"). In particular, an ion detector having a combination of an MCP and an electron impact diode is characterized by a long life and a large maximum output current.

For example, Patent Document 1 (Japanese Patent Application Laid-Open No. 2017-16918) discloses an ion detector including a mesh electrode and a focus electrode disposed between an MCP and an AD. Patent Document 2 (Japanese Patent Application Laid-Open No. H7-73847) discloses an ion detector including a focus electrode disposed between an MCP and a semiconductor detection element. Document 3 (Japanese Patent Application Laid-Open No. 2004-533611) discloses an MCP detection system including a gate electrode (mesh electrode) disposed between a first MCP and a second MCP which are included in a tandem structure. The mesh electrode in this patent document provides a delayed potential to electrons outputted from the first MCP so as to reduce a rate of electron transfer to the second MCP.

SUMMARY

Technical Problem

As a result of studies on ion detectors in the related art, the present inventors have found the following problem. That is, in principle, as illustrated in FIG. 1A, an ion detector that employs an MCP is constituted by an MCP 10 including an input surface 10*a* and an output surface 10*b*, and a signal output device including an electron detector surface 20. When ions (charged particles) enter the input surface 10*a* (an effective region of the MCP 10), electrons are emitted from the output surface 10*b* in response to the incident ions. Electrons around the output surface 10*b* are accelerated by an electric field between the MCP 10 and the electron detector surface 20 and trace an orbit 35 to the electron detector surface 20. Here, the electrons that have reached the electron detector surface 20 vary greatly in energy (substantially, velocity) and incident angle.

When limiting an area where the electrons arrive, as illustrated in FIG. 1B, an electron lens 30 is disposed between the MCP 10 and the electron detector surface 20, and this electron lens 30 focuses the electrons emitted from the output surface 10*b* of the MCP 10 toward the electron detector surface 20. In FIG. 1B, in order to define an effective region of the electron detector surface 20 and to protect the periphery of the electron detector surface 20, a signal output device 40 may include a mask member 41 comprised of a metal or an insulating material. Typically, in an ion detector having a structure as illustrated in FIG. 1B, transit time spread (hereinafter referred to as "TTS") of electrons is about 150 picoseconds (ps). The energy of the electrons emitted from the output surface 10*b* of the MCP 10 is about zero to 60 eV, and the spread angle at the time of electron output is about ±30 degrees. The variations in energy and incident angle θ of an electron group on the electron detector surface 20 largely depend on the behavior of the electrons around the output surface 10*b* of the MCP 10. Accordingly, when the electron group that varies in energy and output angle is guided toward the electron detector surface 20 having an effective region with a diameter φ of about 1 mm, it is required to limit the diameter φ of the effective region of the MCP 10 to about 25 mm (a convergence limit of the electron lens 30).

On the other hand, an effective region of an MCP required in the field of a quadrupole time-of-flight (Q-TOF) mass spectrometry has a diameter φ of 40 mm or more. In this case, there is a problem that an electron lens structure in the related art cannot sufficiently expand an effective region of an MCP for capturing ions to be detected.

The present invention has been made to solve the problem, and an object of the present invention is to provide an ion detector having an electron lens structure that enables expansion of an effective region of an MCP for capturing ions.

Solution to Problem

In order to solve the problem, an ion detector according to this embodiment includes at least an MCP unit, a signal output device, and a reset unit disposed between the MCP unit and the signal output device. The MCP unit includes an MCP for capturing ions and a first focus electrode serving as an electron lens. Note that the MCP includes a first input surface and a first output surface disposed so as to intersect with a predetermined reference axis while opposing each other, and the MCP outputs an electron from the first output surface in response to an incident ion (charged particle) on the first input surface. The first focus electrode is disposed on the first output surface of the MCP and has a shape surrounding the reference axis. The signal output device is disposed on the opposite side of the MCP relative to the first focus electrode and includes an electron detector surface intersecting with the reference axis. Furthermore, the reset unit disposed between the MCP and the signal output device includes a reset element and a second focus electrode serving as an electron lens. In this manner, in the ion detector, it is possible to enable an electron lens structure including the reset element disposed between two adjacent electron lenses.

In particular, in the reset unit, the reset element includes a second input surface and a second output surface opposing each other and intersecting with the reference axis between the MCP unit and the signal output device. Furthermore, the reset element is arranged in such a manner that the second input surface faces the MCP unit and the second output surface faces the signal output device. Still further, on the second output surface, the reset element resets variations in incident angle and velocity of the electron on the second input surface. The second focus electrode is disposed between the reset element and the signal output device and has a shape surrounding the reference axis.

Each embodiment according to the present invention will be fully understood from the following detailed description and the accompanying drawings. The following Examples are provided for purposes of illustration and not limitation.

Furthermore, the following detailed description will clarify a range of application of the present invention. Although the detailed description and specific examples represent preferred embodiments of the present invention, those examples are for illustration purpose. It is clear that various modifications and amendments within the scope of the present invention are unequivocal for those skilled in the art.

Advantageous Effects of Invention

An embodiment of the present invention enables an electron lens structure in which a reset element configured to reset variations in incident angle and velocity of an electron is disposed between first and second focus electrodes each functioning as an electron lens that is controlled independently. Accordingly, even when an effective region of an MCP for capturing ions is increased, it is possible to focus electrons to a desired minute region.

DETAILED DESCRIPTION

Embodiment of the Present Invention

Figure 1A:
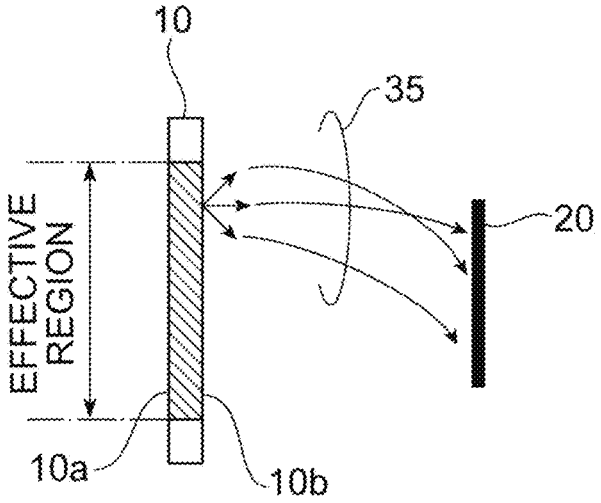
FIGS. 1A and 1B are views for explaining a problem of an ion detector in the related art.
Figure 1B:
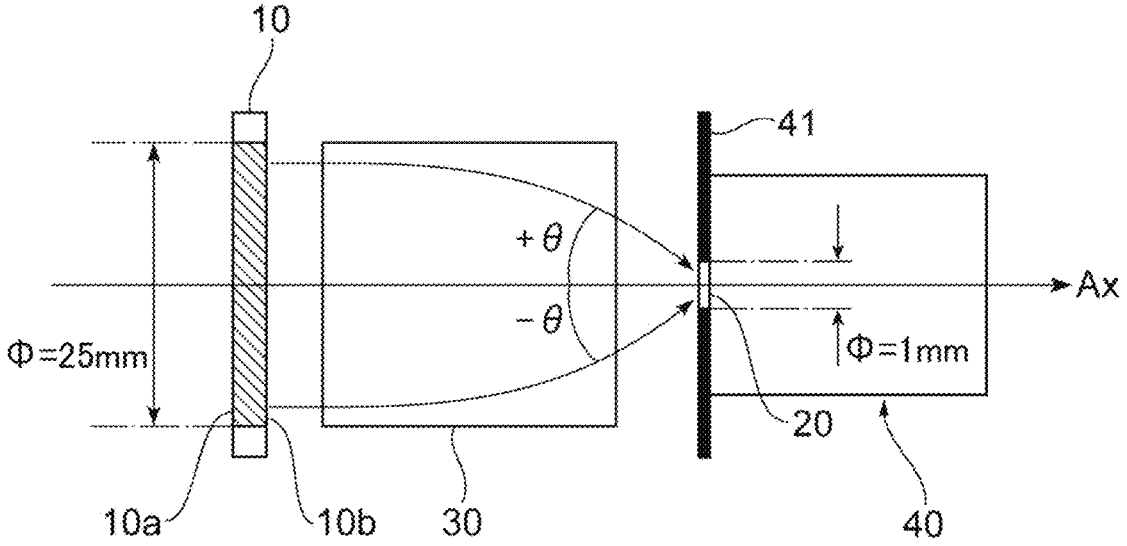

First, the contents of embodiments of the present invention will be separately recited and described.

(1) As an aspect, an ion detector according to this embodiment includes at least an MCP unit, a signal output device, and a reset unit disposed between the MCP unit and the signal output device. The MCP unit includes an MCP for capturing ions and a first focus electrode serving as an electron lens. Note that the MCP includes a first input surface and a first output surface disposed so as to intersect with a predetermined axis while opposing each other, and the MCP outputs an electron from the first output surface in response to an incident ion (charged particle) on the first input surface. The first focus electrode is disposed on the first output surface of the MCP and has a shape surrounding the reference axis. The signal output device is disposed on the opposite side of the MCP relative to the first focus electrode and includes an electron detector surface intersecting with the reference axis. Furthermore, the reset unit disposed between the MCP and the signal output device includes a reset element and a second focus electrode serving as an electron lens. In this manner, in the ion detector, it is possible to enable an electron lens structure including the reset element disposed between two adjacent electron lenses. In addition, each of the first and second focus electrodes may include a plurality of electrodes disposed separately from each other.

In particular, in the reset unit, the reset element includes a second input surface and a second output surface disposed between the MCP unit and the signal output device so as to intersect with the reference axis while opposing each other. Furthermore, the reset element is arranged in such a manner that the second input surface faces the MCP unit and the second output surface faces the signal output device. Still further, on the second output surface, the reset element resets variations in incident angle and velocity of the electron on the second input surface. The second focus electrode is disposed between the reset element and the signal output device and has a shape surrounding the reference axis.

The ion detector according to this embodiment with such a structure enables an electron lens structure in which the reset element configured to reset on the second output surface variations in incident angle and velocity of the electron on the second input surface is disposed between the first and second focus electrodes each functioning as an electron lens that is controlled independently. With this configuration, it is possible to expand an effective region of the MCP unit beyond the capability of the electron lenses or the first and second focus electrodes.

(2) As an aspect of this embodiment, the reset element may include an intermediate MCP including a second input surface and a second output surface. In this case, the second input surface in the intermediate MCP preferably has an area of an effective region smaller than an area of an effective region on the first input surface in the MCP. As an aspect of this embodiment, the reset element may include a channel electron multiplier (hereinafter referred to as "CEM") including the second input surface, the second output surface, an electron input opening disposed on the second input surface, and an electron output opening disposed on the second output surface.

(3) On the other hand, as an aspect of this embodiment, the signal output device may include an electron impact diode including an electron capture surface serving as the electron detector surface. The electron impact diode includes an avalanche diode (AD) and the like. Furthermore, as an aspect of this embodiment, the signal output device may include a fluorescent material and a photodetector. The fluorescent material has a first surface serving as the electron detector surface and a second place opposing the first surface, and the photodetector is disposed on the opposite side of the second focus electrode relative to the fluorescent material. The photodetector includes, for example, an avalanche photodiode (hereinafter referred to as "APD") and a photomultiplier.

(4) As an aspect of the embodiment, it is preferable that the ion detector should further include a first mesh electrode disposed between the MCP and the first focus electrode and a second mesh electrode disposed between the reset element and the second focus electrode. The first mesh electrode serves as an electrode for extracting an electron (velocity or energy is almost zero) on the first output surface of the MCP toward the first focus electrode. The second mesh electrode serves as an electrode for extracting an electron (velocity or energy is almost zero) on the second output surface of the reset element to the second focus electrode.

(5) As an aspect of the embodiment, it is preferable that the ion detector should further include a voltage supply circuit configured to set a potential of at least the first input surface of the MCP, the first output surface of the MCP, the second input surface of the reset element, and the second output surface of the reset element. The voltage supply circuit includes a power supply unit and a constant voltage generator.

The power supply unit generates an electromotive force to ensure a potential difference between a first terminal electrically connected to the first input surface of the MCP and a second terminal electrically connected to the second output surface of the reset element. The constant voltage generator holds a first target potential for adjusting a potential of the first output surface of the MCP and a second target potential for adjusting a potential of the second input surface of the reset element. The constant voltage generator includes a first reference node, a first potential fixing element, a second reference node, a second potential fixing element, and a constant voltage supply. The first reference node is disposed between the first terminal and the second terminal and is set to have the first target potential. The first potential fixing element eliminates a potential difference between the first output surface of the MCP and the first reference node. The second reference node is disposed between the first reference node and the second terminal and is set to have the second target potential. The second potential fixing element eliminates a potential difference between the second input surface of the reset element and the second reference node. The constant voltage supply causes a voltage drop to ensure a potential difference between at least the second terminal and the second reference node.

(6) As an aspect of this embodiment, the ion detector may further include one or more auxiliary reset units disposed along the reference axis from the reset unit to the signal output device. Each of the auxiliary reset units includes an auxiliary reset element and a third focus electrode as similar to the reset unit. Each of the auxiliary reset elements includes a third input surface on a side closer to the MCP unit and a third output surface on a side closer to the signal output device. Furthermore, on the third output surface, each of the auxiliary reset elements resets variations in incident angle and velocity of the electron on the third input surface. The third focus electrode is disposed on the opposite side of the third input surface relative to the third output surface and has a shape surrounding the reference axis. Note that the third focus electrode may also include a plurality of electrodes disposed separately from each other.

Each aspect recited in [Embodiment of the Present Invention] is applicable to other aspects or any combinations of the aspects.

Details of Embodiment of the Present Invention

Specific examples of the ion detector according to the present invention will hereinafter be described in detail with reference to the accompanying drawings. Note that the present invention is not limited to these examples but represented by the claims and intended to include contents equivalent to the claims and all modifications within the scope of the claims. Note that the same elements in descriptions of the drawings will be denoted by the same reference numerals, and redundant descriptions thereof will be omitted.

Figure 2:
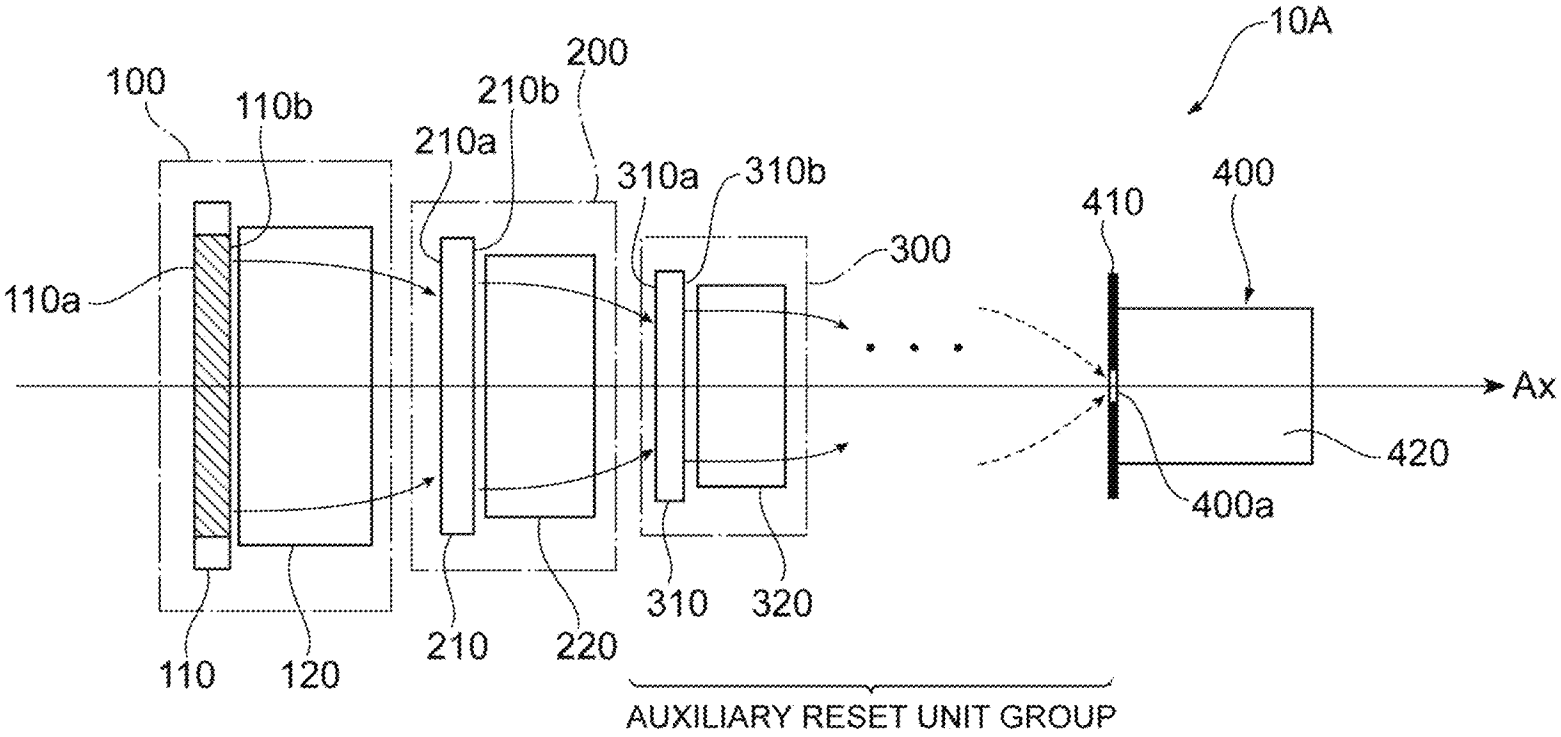
FIG. 2 is a view for explaining a main section including an electrode structure of an ion detector according to this embodiment.

FIG. 2 is a view for explaining a main section including an electrode structure of the ion detector according to this embodiment. As illustrated in FIG. 2, an ion detector 10A according to this embodiment, various types of units are arranged along a reference axis AX. Specifically, in the ion detector 10A, an MCP unit 100, a detection unit 400, and a reset unit 200 are arranged disposed on the reference axis AX between the MCP unit 100 and the detection unit 400. On the reference axis AX between the reset unit 200 and the detection unit 400, note that one or more auxiliary reset units 300 (part of an auxiliary reset unit group) having a structure similar to the reset unit 200 may also be disposed in series.

Specifically, the MCP unit 100 includes an MCP 110 and an electron lens (first focus electrode) 120. The MCP 110 includes a first input surface 110*a* and a first output surface 110*b* disposed so as to intersect with the reference axis AX while opposing each other, and the electron lens 120 faces the first output surface 110*b* of the MCP 110. The reset unit 200 includes a reset element 210 and an electron lens (second focus electrode) 220. The reset element 210 includes a second input surface 210*a* and a second output surface 210*b* disposed so as to intersect with the reference axis AX while opposing each other, and the electron lens 220 faces the second output surface 210*b* of the reset element 210. On the second output surface 210*b*, the reset element 210 resets variations in velocity (energy) and incident angle of electrons on the second input surface 210*a*. The detection unit 400 includes a signal output device 420 and a mask member (comprised of a metal or insulating material) 410. The signal output device 420 includes an electron detector surface 400*a* intersecting with the reference axis AX. The mask member 410 defines an effective region of the electron detector surface 400*a* and protects the periphery of the electron detector surface 400*a*.

In this embodiment, one or more auxiliary reset units 300 may be disposed between the reset unit 200 and the detection unit 400. Each of the auxiliary reset units 300 has a structure similar to the reset unit 200. In other words, each auxiliary reset unit 300 includes an auxiliary reset element 310 and an electron lens (third focus electrode) 320. The auxiliary reset element 310 includes a third input surface 310*a* and a third output surface 310*b* disposed so as to intersect with the reference axis AX while opposing each other, and the electron lens 320 faces the third output surface 310*b* of the auxiliary reset element 310 and having a shape surrounding the reference axis AX. On the third output surface 310*b*, the auxiliary reset element 310 resets variations in velocity (energy) and incident angle of electrons on the third input surface 310*a*.

Figure 3A:
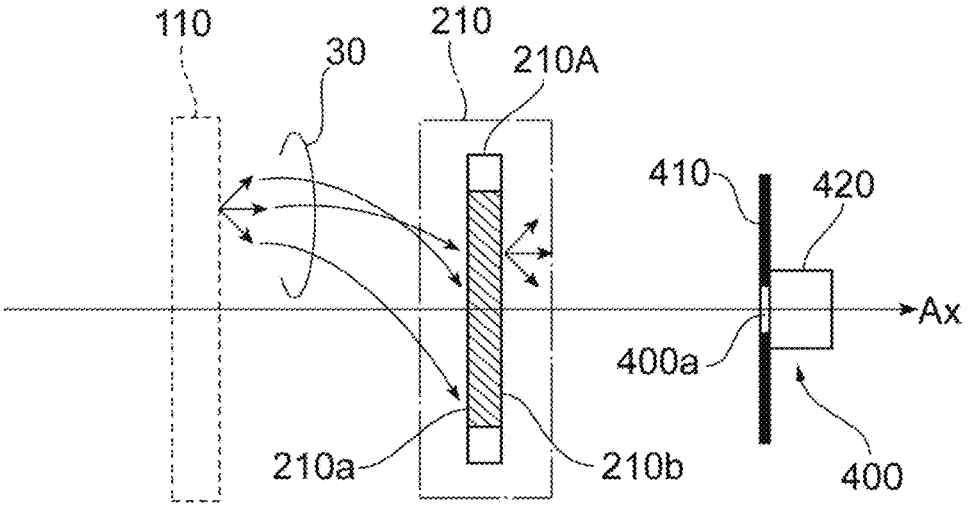
FIGS. 3A to 3C are views illustrating an example of a configuration applicable to a reset element and a signal output device in the ion detector according to this embodiment.
Figure 3B:
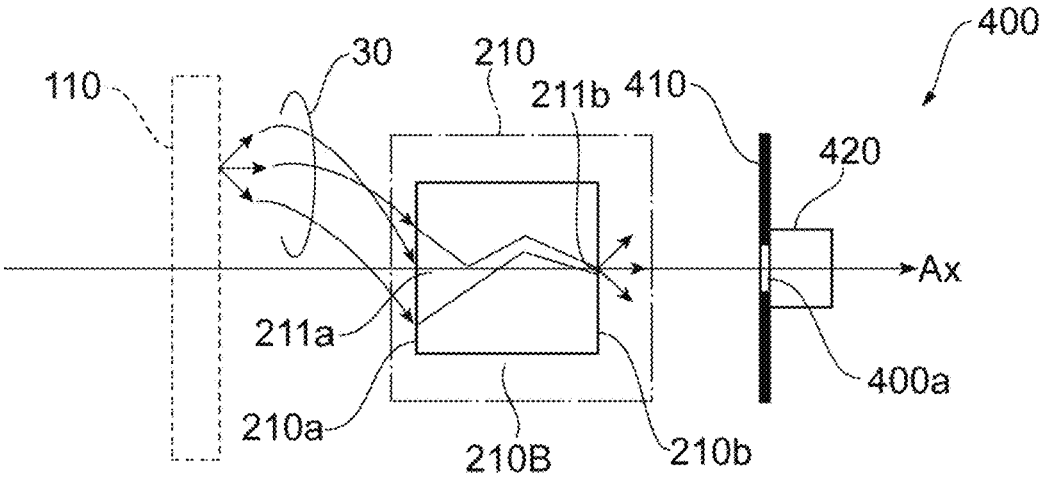

FIGS. 3A and 3B are views each illustrating a configuration example applicable to the reset element 210 in the ion detector 10A illustrated in FIG. 2 (note that an electron lens is not illustrated). FIG. 3A is an example in which an intermediate MCP 210A is employed as the reset element 210. The intermediate MCP 210A includes a second input surface 210*a* and a second output surface 210*b* opposing each other. FIG. 3B is an example in which a CEM 210B is employed as the reset element 210. The CEM 210B includes a second input surface 210*a* and a second output surface

210*b* opposing each other. The second input surface 210*a* includes an electron input opening 211*a* of the CEM 210B, and the second output surface 210*b* includes an electron output opening 211*b* of the CEM 210B. As illustrated in FIGS. 3A and 3B, an orbit 30 of electrons that reach either the second input surface 210*a* of the intermediate MCP 210A or the electron input opening 211*a* of the CEM 210B varies greatly in energy (velocity) and incident angle. On the second output surface 210*b,* both the intermediate MCP 210A and the CEM 210B which are employable as the reset element 210 function to reset variations in velocity and incident angle of electrons on the second input surface 210*a*.

Figure 3C:
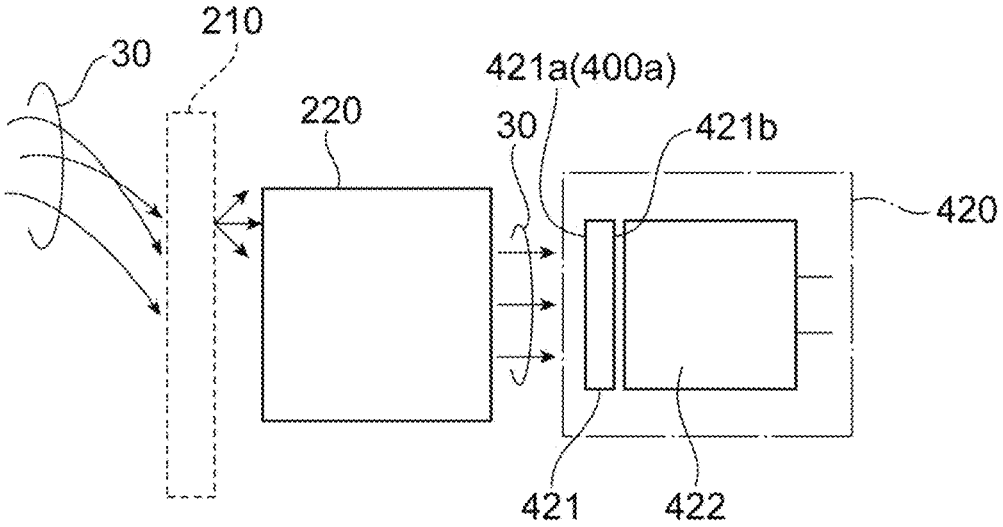

FIG. 3C is a view illustrating a configuration example applicable to the signal output device 420 in the ion detector 10A illustrated in FIG. 2 (note that an electron lens is not illustrated). FIG. 3C is an example in which a fluorescent material 421 and a photodetector 422 are employed as the signal output device 420. The fluorescent material 421 includes a second input surface 421*a* corresponding to the electron detector surface 400*a* and a first fluorescent light output surface 421*b* that emits fluorescent light. Examples of the photodetector 422 include an APD and a photomultiplier.

Hereinafter described is the simplest structure in which the reset unit 200 is disposed between the MCP unit 100 and the detection unit 400. Specifically, the intermediate MCP 210A illustrated in FIG. 3A is assumed to be employed as the reset element 210. As the signal output device 420, an AD is employed.

Figure 4:
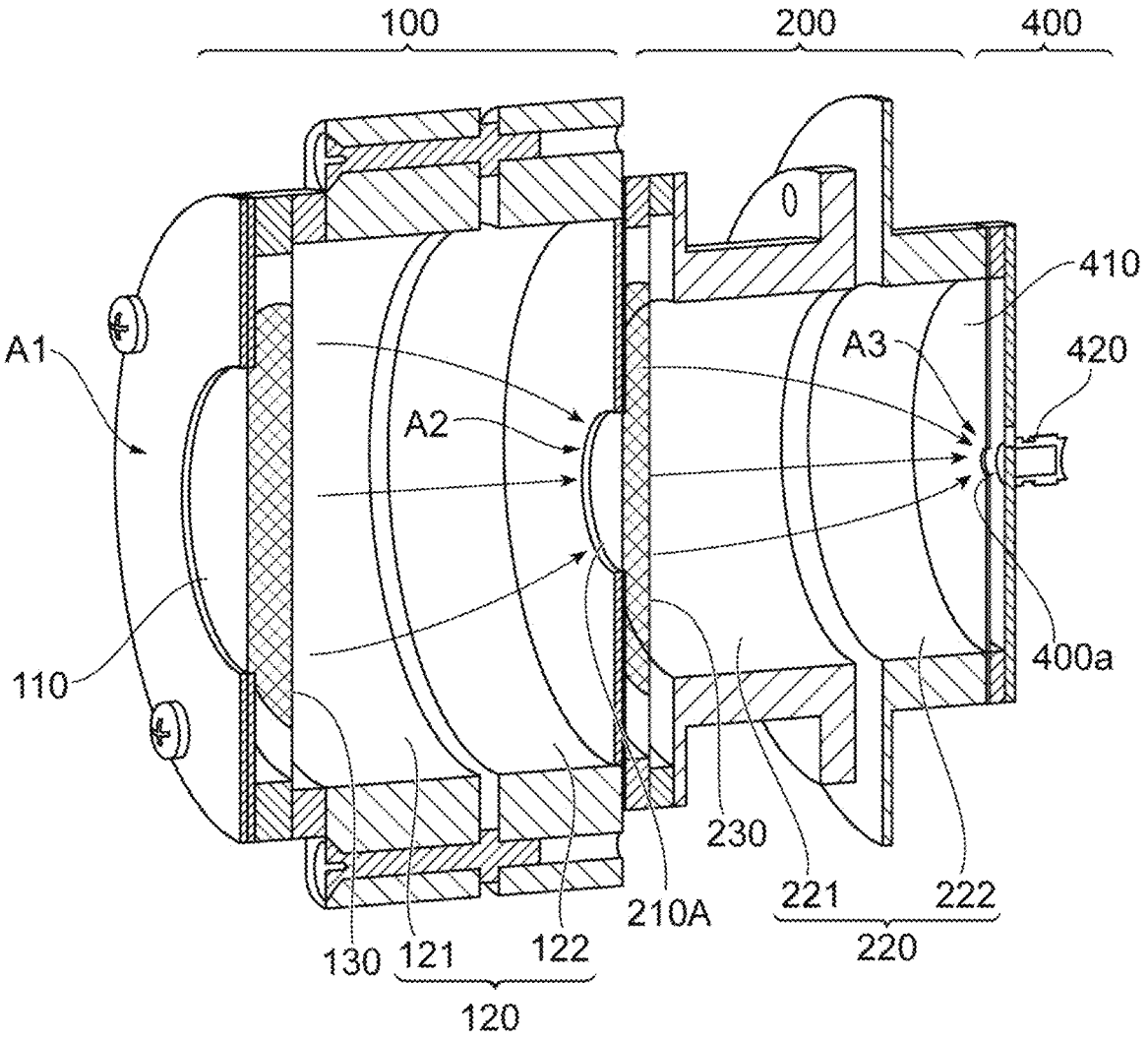
FIG. 4 is a cross-sectional view illustrating an example of a specific basic structure (a main section including an electrode structure) of the ion detector according to this embodiment.
Figure 5A:
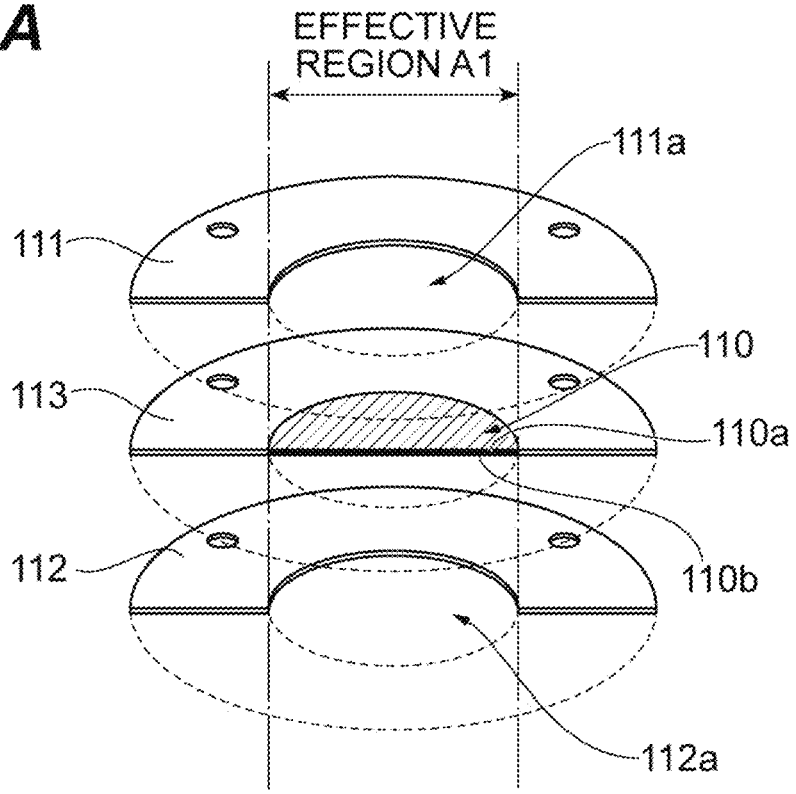
FIGS. 5A and 5B are views illustrating an example of a structure that defines an effective region of an MCP 110 and a reset element (intermediate MCP 210A) according to this embodiment.
Figure 5B:
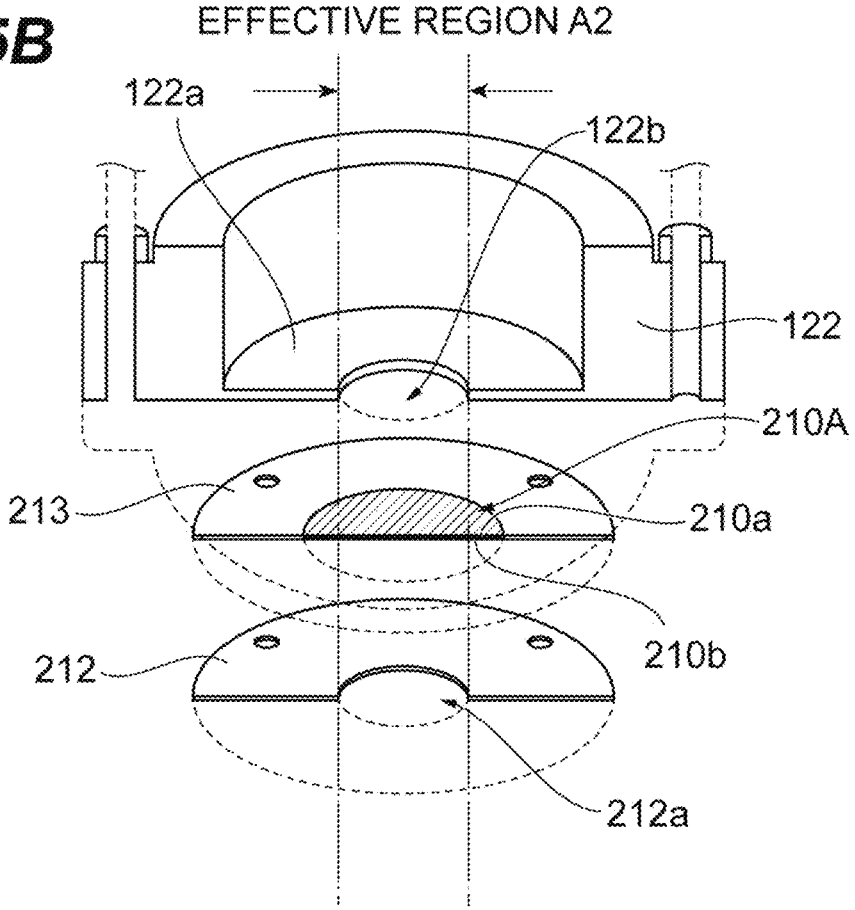
Figure 6:
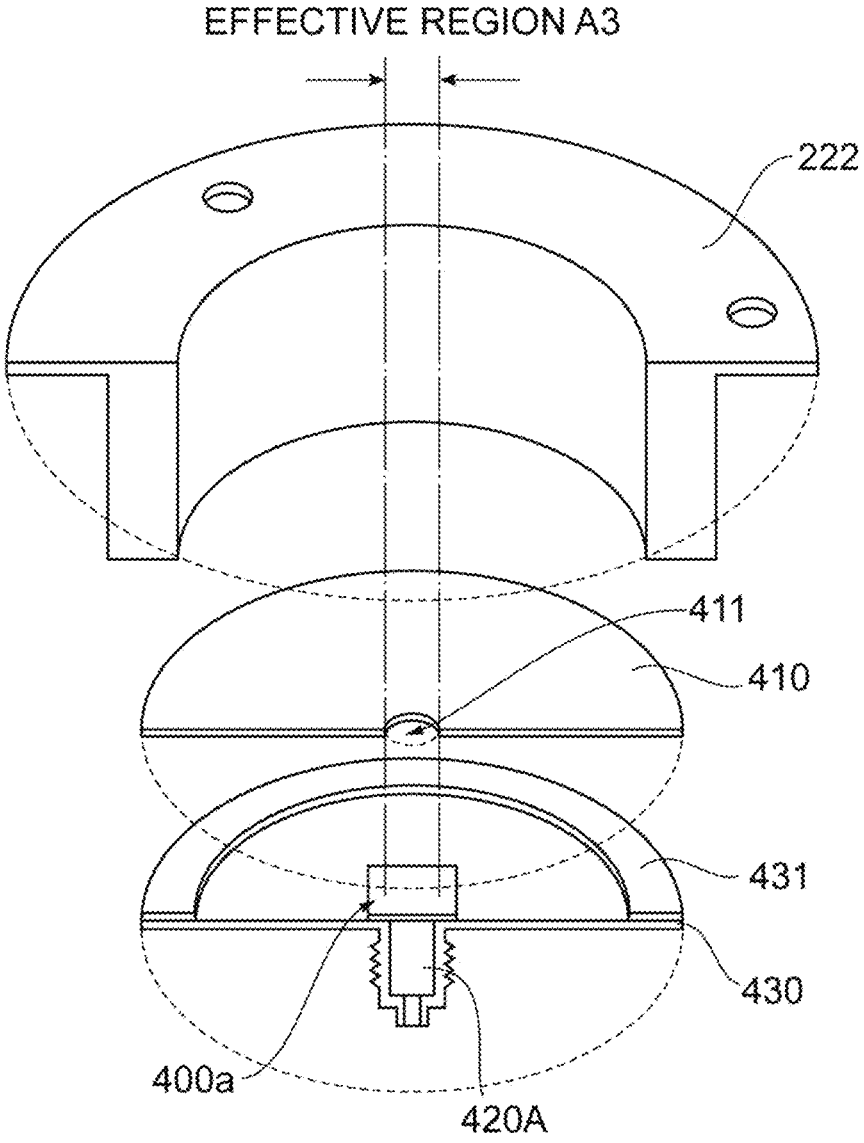
FIG. 6 is a view illustrating an example of a structure that defines an effective region of an electron detector surface of the signal output device according to this embodiment.

FIG. 4 is a cross-sectional view illustrating an example of a specific basic structure (a main section including an electrode structure) of the ion detector according to this embodiment. FIG. 5A is a view for explaining a structure that defines an effective region A1 of the MCP 110 in the MCP unit 100 of the ion detector illustrated in FIG. 4. FIG. 5B is a view for explaining a structure that defines an effective region A2 of the intermediate MCP 210A in the reset unit 200 of the ion detector illustrated in FIG. 4. Furthermore, FIG. 6 is a view for explaining a structure that defines an effective region A3 of the electron detector surface 400*a* in an AD 420A (the signal output device 420).

The MCP unit 100 includes the MCP 110 held by an input electrode 111 and an output electrode 112, a first mesh electrode 130 fixed to the output electrode 112 via an insulating spacer, and the electron lens 120. The electron lens 120 includes a pair of first focus electrodes 121 and 122 each having a shape surrounding the reference axis AX. One first focus electrode 121 included in a part of the electron lens 120 is fixed to the first mesh electrode 130 via an insulating spacer, and the other first focus electrode 122 is fixed to the first focus electrode 121 via an insulating spacer. In this MCP unit 100, TTS of electrons emitted from the MCP 110 is 180 ps. The effective region A1 of the MCP 110 is set to have a diameter φ of, for example, 42 mm. Specifically, as illustrated in FIG. 5A, the MCP 110 is housed in an opening of an insulating spacer 113. The input electrode 111 is brought into contact with one surface of the insulating spacer 113. The input electrode 111 has an opening 111*a* for exposing a central portion of the first input surface 110*a* of the MCP 110, and the outer periphery of the first input surface 110*a* is in direct contact with the input electrode 111. On the other hand, the other surface of the insulating spacer 113 is in contact with the output electrode 112. The output electrode 112 also has an opening 112*a* for exposing a central portion of the first output surface 110*b* of the MCP 110, and the outer periphery of the first output surface 110*b* is in direct contact with the output electrode 112.

The reset unit 200 includes the intermediate MCP 210A held by an input electrode and an output electrode 212, a second mesh electrode 230 fixed to the output electrode 212 via an insulating spacer, and the electron lens 220. The electron lens 220 includes a pair of second focus electrodes 221 and 222 each having a shape surrounding the reference axis AX. One second focus electrode 221 included in a part of the electron lens 220 is fixed to the second mesh electrode 230 via an insulating spacer, and the other second focus electrode 222 is fixed to the second focus electrode 221 via an insulating spacer. In this reset unit 200, TTS of electrons emitted from the intermediate MCP 210A is 220 ps. As illustrated in FIG. 5B, the other first focus electrode 122 included in a part of the electron lens 120 of the MCP 110 assumes a role as the input electrode of the reset unit 200. Specifically, the other first focus electrode 122 includes a bottom 122*a* that is brought into contact with the intermediate MCP 210A and with an insulating spacer 213. This bottom 122*a* serves as an input electrode for the intermediate MCP 210A. Furthermore, the bottom 122*a* includes an opening 122*b* for exposing a central portion of the second input surface 210*a* of the intermediate MCP 210A, and the outer periphery of the second input surface 210*a* is in direct contact with the bottom 122*a*. The effective region A2 of the intermediate MCP 210A is set to have a diameter φ of, for example, 20 mm by the opening 122*b* disposed in the bottom 122*a*. The intermediate MCP 210A is housed in an opening of the insulating spacer 213. One surface of the insulating spacer 213 is in contact with the bottom 122*a* of the other first focus electrode 122 serving as the input electrode. The other surface of the insulating spacer 213 is in contact with the output electrode 212. This output electrode 212 also has an opening 212*a* for exposing a central portion of the second output surface 210*b* of the intermediate MCP 210A, and the outer periphery of the second output surface 210*b* is in direct contact with the output electrode 212.

The detection unit 400 includes the signal output device 420 having the electron detector surface 400*a,* and the mask member 410 defining the effective region A3 of the electron detector surface 400*a*. FIG. 6 shows a specific structure that defines the effective region A3 of the electron detector surface 400*a*. That is, the other second focus electrode 222 included in a part of the electron lens 220 has an end closer to the signal output device 420 to which the mask member 410 comprised of a metal or an insulating material is fixed so as to close an opening of the end. The mask member 410 has an opening 411 defining the effective region A3 of the electron detector surface 400*a* (for example, a diameter φ is set to 1 mm). The AD 420A serving as the signal output device 420 is fixed to an insulating disk 430. On the outer periphery of one surface of the insulating disk 430, an insulating ring 431 that has a shape surrounding the electron detector surface 400*a* is disposed to ensure a predetermined space between the metallic mask member 410 and the insulating disk 430.

First Embodiment

Figure 7:
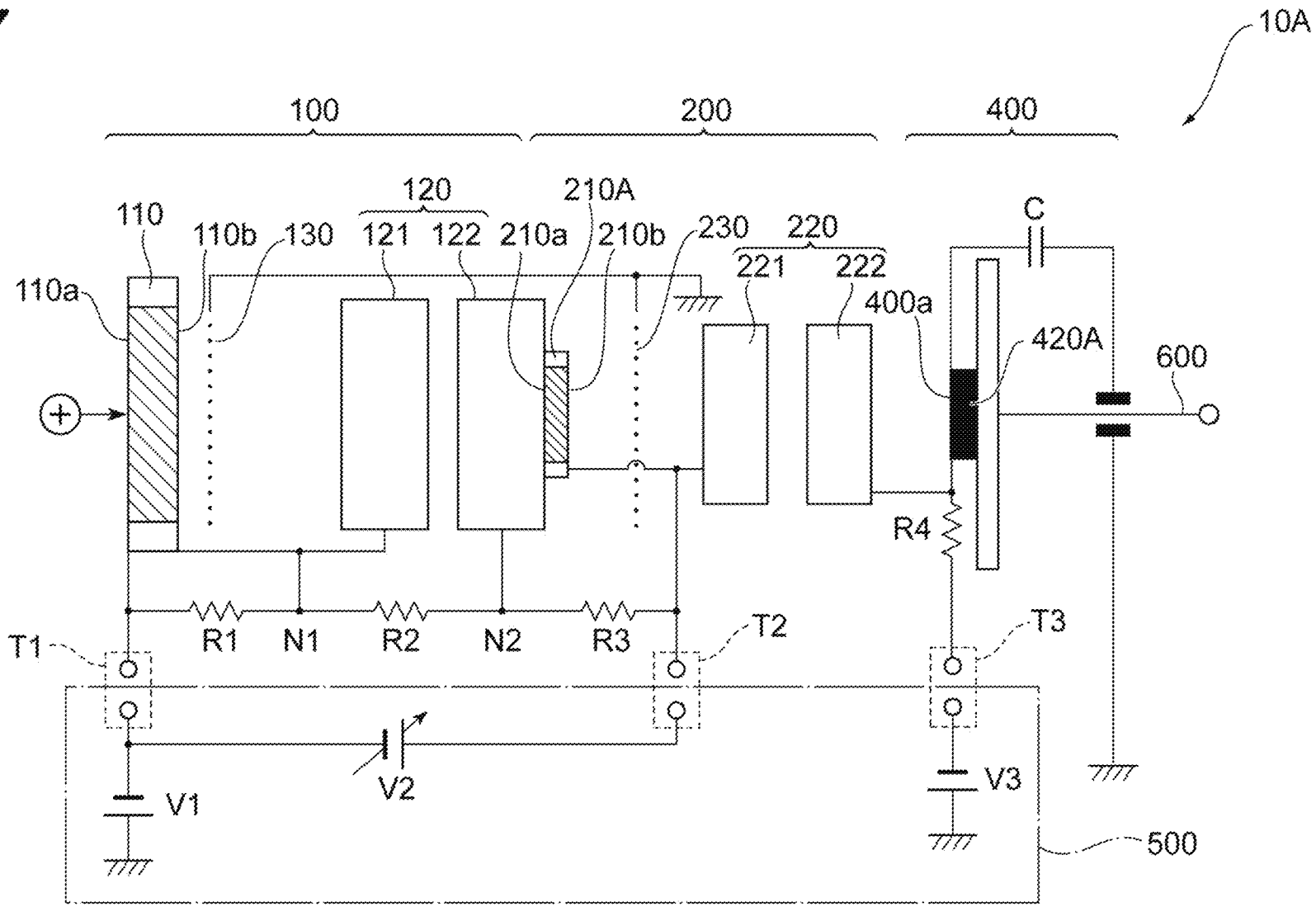
FIG. 7 is a view illustrating a configuration example of an ion detector according to a first embodiment.

FIG. 7 is a view illustrating a configuration example of an ion detector 10A according to a first embodiment. The ion detector 10A according to the first embodiment illustrated in FIG. 7 comprises a voltage supply circuit and a main section including an electrode structure. The main section includes an MCP unit 100, a reset unit 200, and a detection unit 400.

The MCP unit 100 includes an MCP 110 having a function of electron multiplication, an electron lens 120, and a first mesh electrode 130 disposed between the MCP 110 and the electron lens 120. The MCP 110 includes a first input surface 110*a* where ions (for example, positive ions in FIG. 7) arrive and a first output surface 110*b* opposing the first input surface 110*a*. In the MCP 110, a resistance value between the first input surface 110*a* and the first output surface 110*b* is 10 MΩ. The first mesh electrode 130 is set to have a ground potential GND and extracts electrons around the first output surface 110*b* of the MCP 110 to the electron lens 120. The electron lens 120 includes a pair of first focus electrodes 121 and 122. One first focus electrode 121 is set to be unipotential with the first output surface 110*b* of the MCP 110.

The reset unit 200 includes an intermediate MCP 210A serving as a reset element 210, an electron lens 220, and a second mesh electrode 230 disposed between the intermediate MCP 210A and the electron lens 220. The intermediate MCP 210A includes a second input surface 210*a* set to be unipotential with the first focus electrode 122 and a second output surface 210*b* opposing the second input surface 210*a*. In the intermediate MCP 210A, a resistance value between the second input surface 210*a* and the second output surface 210*b* is 40 MΩ. In this configuration, on the second output surface 210*b*, the intermediate MCP 210A serving as the reset element 210 resets variations in velocity and incident angle of electrons on the second input surface 210*a*. The second mesh electrode 230 is set to have a ground potential GND as similar to the first mesh electrode 130 and extracts electrons around the second output surface 210*b* of the intermediate MCP 210A to the electron lens 220. The electron lens 220 includes a pair of second focus electrodes 221 and 222. One second focus electrode 221 is set to be unipotential with the second output surface 210*b* of the intermediate MCP 210A.

The detection unit 400 includes an AD 420A as a signal output device 420, and a mask member 410 defining an effective region A3 of an electron detector surface 400*a* of the AD 420A. The AD 420A has one terminal connected to a negative potential via a resistance R4, and the other terminal connected to the ground potential GND via a capacitor C. A signal amplified by the AD 420A is taken out from a signal line 600. The other second focus electrode 222 included in a part of the electron lens 220 is connected to the negative potential via the resistance R4 as similar to one terminal of the AD 420A.

The voltage supply circuit according to the first embodiment includes at least a power supply unit 500 and a constant voltage generator. The power supply unit 500 has a first power supply V1, a second power supply V2, and a third power supply V3. The first power supply V1 sets a potential of the first input surface 110*a* of the MCP 110 via a first terminal T1. The second power supply V2 ensures a predetermined potential difference between the first terminal T1 electrically connected to the first input surface 110*a* of the MCP 110 and a second terminal T2 electrically connected to the second output surface 210*b* of the intermediate MCP 210A. The third power supply V3 is connected to one terminal of the AD 420A via a third terminal T3 and the resistance R4. The first power supply V1 is disposed between the ground potential GND and the first terminal T1 and generates an electromotive force for setting a potential of the first terminal T1 to, for example, −7 kV. The second power supply V2 is a variable power supply disposed between the first terminal T1 and the second terminal T2 and generates an electromotive force to ensure a potential difference of, for example, about zero to 3.5 kV between the first input surface 110*a* of the MCP 110 and the second output surface 210*b* of the intermediate MCP 210A. The third power supply V3 is disposed between the ground potential GND and the third terminal T3 and generates an electromotive force for setting a potential of the third terminal T3 to, for example, −350 V.

The constant voltage generator includes resistances R1 to R3 arranged in series between the first terminal T1 and the second terminal T2. In other words, the second power supply V2 and the resistances R1 to R3 are arranged in parallel between the first terminal T1 and the second terminal T2. Potentials of a first reference node N1 and a second reference node N2 are set based on a resistance ratio of the resistances R1 to R3 arranged in series between the first terminal T1 and the second terminal T2. For example, the resistance R1 is 3 MΩ, the resistance R2 is 10 MΩ, the resistance R3 is 2.7 MΩ, and the resistance R4 is 1 kΩ. In other words, the first reference node N1 between the resistance R1 and the resistance R2 is electrically connected to both the first output surface 110*b* of the MCP 110 and one first focus electrode 121. With such a circuit structure, the first reference node N1, the first output surface 110*b*, and the first focus electrode 121 are set to be unipotential. Furthermore, the second reference node N2 between the resistance R2 and the resistance R3 is electrically connected to both the other first focus electrode 122 and the second input surface 210*a* of the intermediate MCP 210A. With such a circuit structure, the second reference node N2, the first focus electrode 122, and the second input surface 210*a* are set to be unipotential.

Hereinafter, operating characteristics of a virtual MCP that includes the MCP 110 and the intermediate MCP 210A will be described with reference to FIGS. 8 and 9 as operating characteristics of the ion detector 10A according to the first embodiment with the aforementioned structure. Furthermore, a convergence limit of a single electron lens will be described with reference to FIG. 10. A first input surface of the virtual MCP corresponds to the first input surface 110*a* of the MCP 110, and a first output surface of the virtual MCP corresponds to the second output surface 210*b* of the intermediate MCP 210A. A potential difference between the first input surface and the first output surface in the virtual MCP (referred to as "input-output voltage") is provided by the second power supply V2 of the power supply unit 500.

Figure 8:
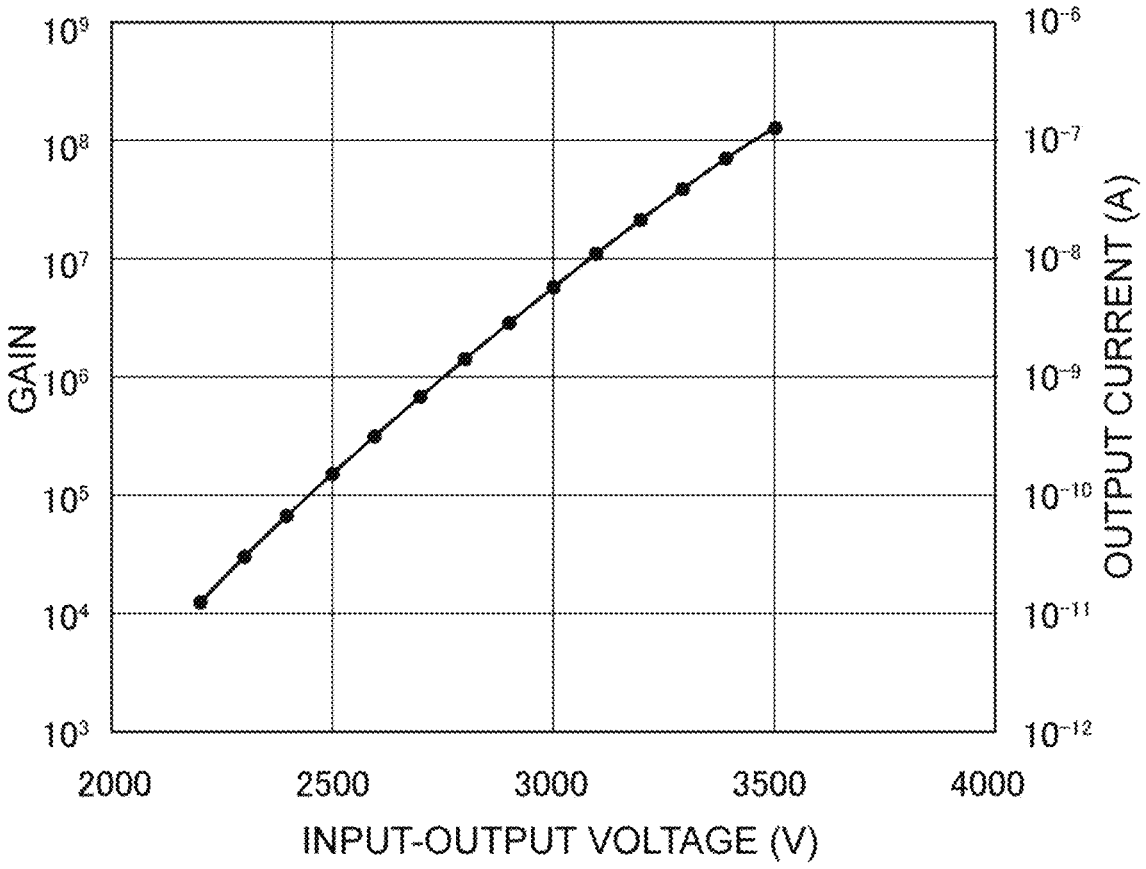
FIG. 8 is a graph illustrating a relation between an input-output voltage (V) and a gain (an output current (A)) of a virtual MCP in the first embodiment.

FIG. 8 is a graph illustrating a relation between an input-output voltage (V) and gain (an output current (A)) of the virtual MCP in the first embodiment (FIG. 7). In this measurement, one second focus electrode 221 set to be unipotential with the second output surface 210*b* of the intermediate MCP 210A is set to have a potential of −4 kV. A potential of the third terminal T3 is set to −350 V by the third power supply V3. FIG. 8 shows that gain and linearity of an output current are maintained relative to an input-output voltage of the virtual MCP.

Figure 9:
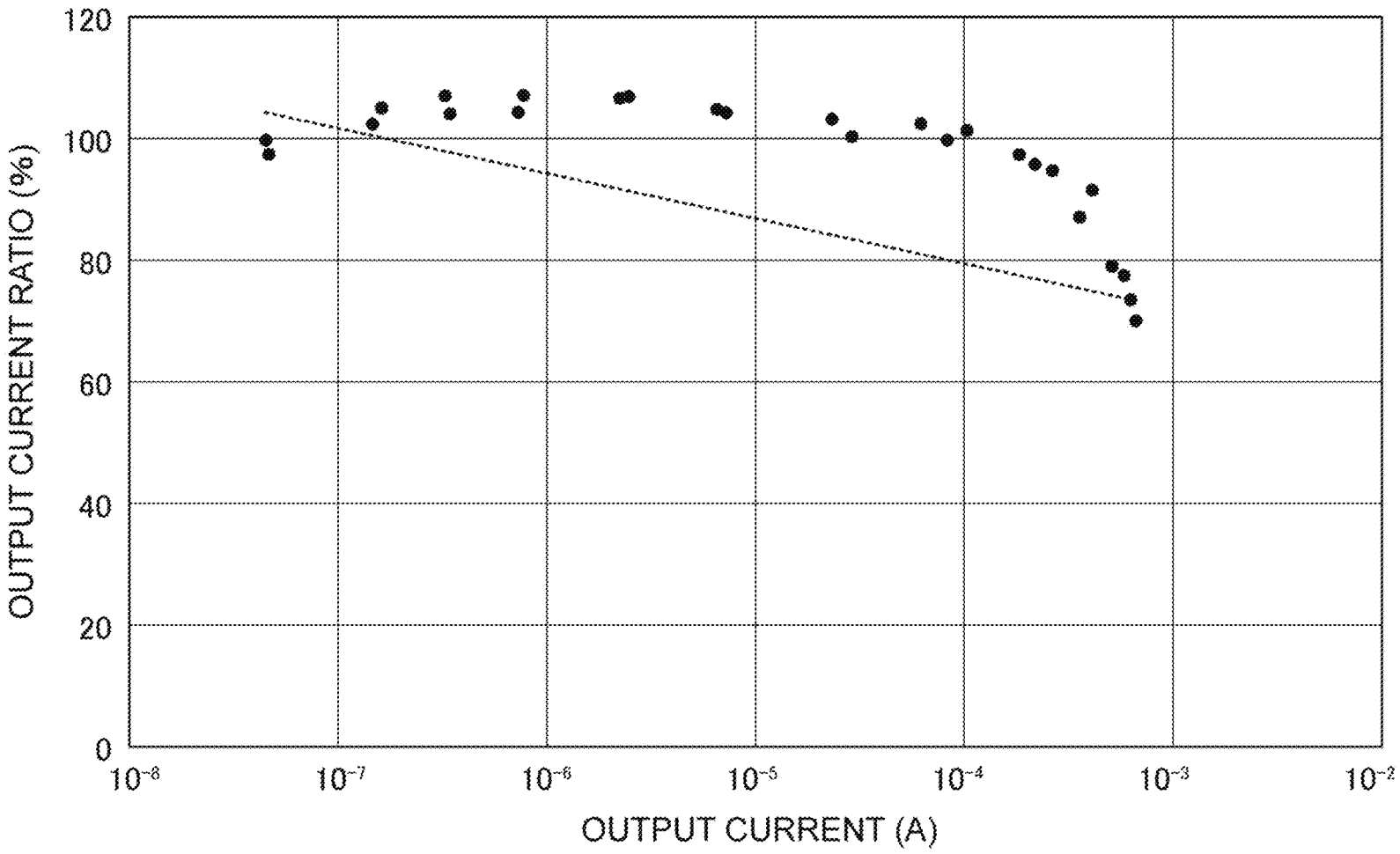
FIG. 9 is a graph illustrating DC linearity (a relation between output current (A) and an output current ratio (%)) of the virtual MCP in the first embodiment.

On the other hand, FIG. 9 is a graph illustrating DC linearity (a relation between an output current (A) and an output current ratio (%)) of the virtual MCP in the first embodiment (FIG. 7). In this measurement, one second focus electrode 221 set to be unipotential with the second output surface 210*b* of the intermediate MCP 210A is set to have a potential of −4 kV. A potential of the third terminal T3 is set to −350 V by the third power supply V3. An input-output voltage of the virtual MCP is set to 3300 V. Note that FIG. 9 also shows measurement results in which an input-output voltage of the virtual MCP is set to 2700 V as data of reference. As is clear from the measurement results in FIG. 9, the DC linearity deteriorates with an increase in output current regardless of fluctuations in input-output voltage of the virtual MCP.

In the ion detector 10A having the structure illustrated in FIG. 7, a virtual MCP in which two MCPs are arranged in multiple stages via an electron lens includes a first input surface (the first input surface 110*a* of the MCP 110) and a first output surface (the second output surface 210*b* of the intermediate MCP 210A) each having a fixed potential. As is clear from FIG. 8, this configuration enables gain control. However, as is clear from FIG. 9, the DC linearity deteriorates with an increase of gain. This is because potentials of both the first output surface 110*b* of the MCP 110 and the second input surface 210*a* of the intermediate MCP 210A decrease (voltage drop) along with a decrease in resistance value of the MCP 110 and the intermediate MCP 210A and an increase in output current due to heat generation during operation. Such a gain increase between the first output surface 110*b* of the MCP 110 and the second input surface 210*a* of the intermediate MCP 210A leads to a loss of linearity (DC linearity) of the virtual MCP caused by DC voltage control.

In this specification, the "DC linearity" represents operating characteristics of the MCP calculated by a ratio between an amount of ion input to the MCP (current value conversion) and an output current of the MCP (hereinafter referred to as "input/output current ratio"). When a small amount of ion is input to the MCP, the input/output current ratio shows a constant value (linearity). However, when an excessive amount of ion is input to the MCP, the input/output current ratio deviates from a reference value (±10%). The reference value (a.u.) is an input/output current ratio in a range that sufficiently enables the DC linearity (a range where the output current is as low as about 1 to 100 nA), which is given by the following expression (1).

$$\text{Output current (A)/Amount of ion input (A)} \quad (1)$$

On the other hand, the DC linearity (%) is given by the following expression (2). Accordingly, when the output current is in a relatively low range, it is natural that the input/output current ratio should substantially coincide with the reference value (the DC linearity is 100%). However, the more the output current increases beyond the above range, the more the voltage drop at an output terminal of the MCP increases, which makes a difference between the input/output current ratio and the reference value conspicuous (the DC linearity is lost).

$$\text{Output current (A)/Amount of ion input (A)/Reference value (a.u.)}\times 100 \quad (2)$$

Here, "amount of ion input" is given by a current value caused by ions reaching an input terminal of the MCP, and "output current" is given by a current value caused by electrons reaching an anode from the MCP.

Figure 10:
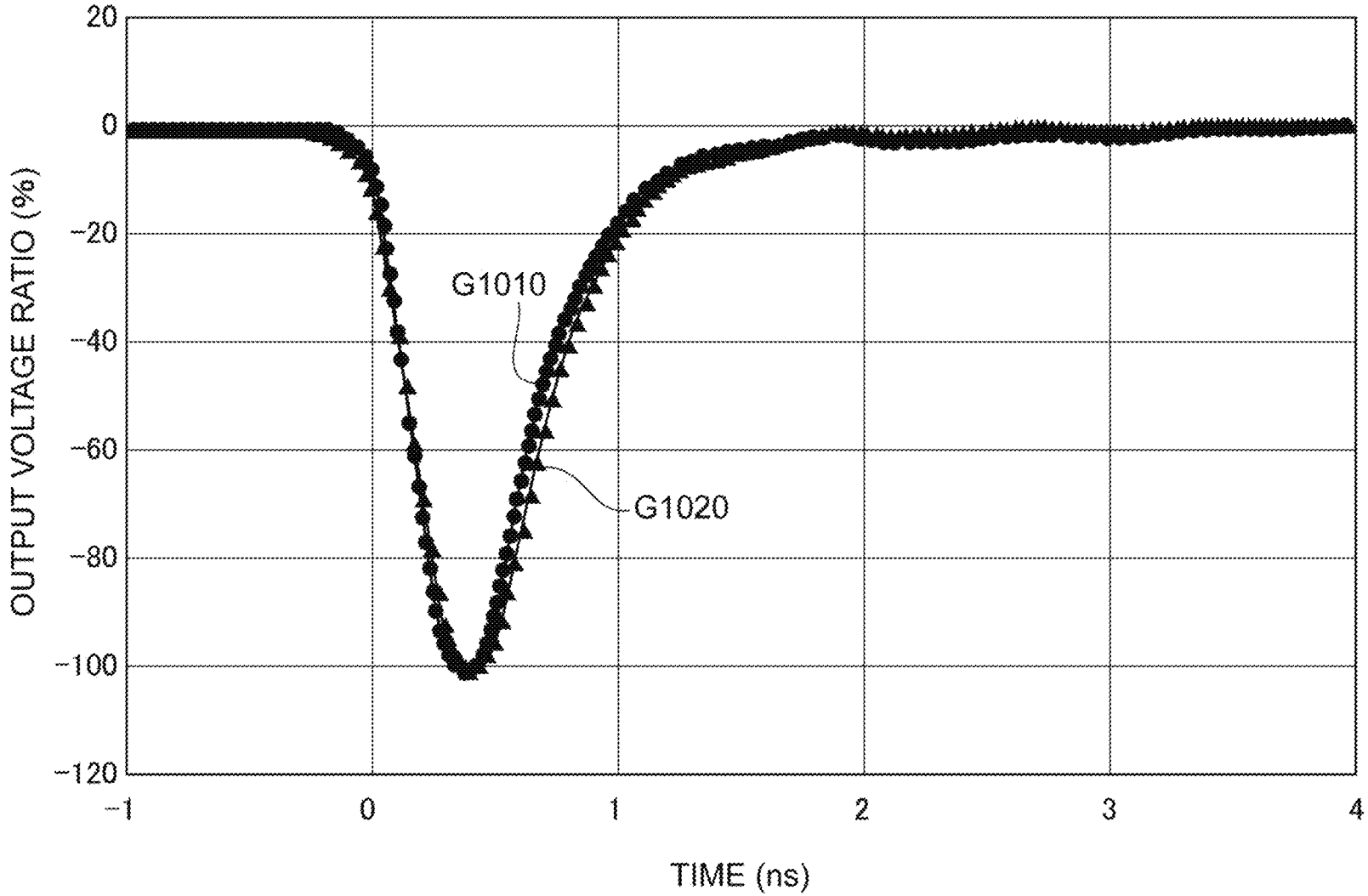
FIG. 10 is a graph illustrating response time characteristics (time (ns) and an output voltage ratio (%)) of an MCP having effective regions with different diameters when a single electron is input.

Next, FIG. 10 is a graph illustrating response time characteristics (time (ns) and an output voltage ratio (%)) of MCPs having effective regions with different diameters when a single electron is input. In FIG. 10, a graph G1010 shows time response characteristics of a first configuration including an MCP having an effective region with a diameter φ=25 mm, an electron lens (focus electrode), and an AD, while a graph G1020 shows time response characteristics of a second configuration including an MCP having an effective region with a diameter φ=42 mm, an electron lens, and an AD. In the first configuration (graph G1010), the full width at half maximum (FWHW) is 550 ps. In the second configuration (graph G1020), FWHW is 570 ps, resulting in deterioration of the time response characteristics as compared with the first configuration. This measurement result shows that a single electron lens has a convergence limit. On the other hand, when focusing electrons on a certain minute area (for example, an effective region having a diameter φ of about 1 mm), it is difficult to enlarge an effective region of an MCP to be employed. In order to solve such a problem, the reset unit 200 in this embodiment is disposed between the MCP unit 100 and the detection unit 400. The reset unit 200 includes the reset element 210 such as the intermediate MCP 210A and the CEM 210B. On the second output surface 210*b*, the reset element 210 resets variations in velocity and incident angle of electrons on the second input surface 210*a*. The reset element 210 is disposed between the MCP 110 and the signal output device 420 so that it is possible to enable multi-stage electron lenses in which the electron lenses 120 and 220 are arranged between the MCP 110 and the reset element 210, and, between the reset element 210 and the signal output device 420.

Second Embodiment

As described above, an MCP is constituted by a lead-glass structure provided with a secondary electron emission layer or the like, and requires s a resistance value of 10 MΩ or more (a resistance value from a first input surface to a first output surface) to ensure stable operation. Note that an MCP in the related art including a lead-glass structure employs a lead layer precipitated by reduction treatment of PbO a resistance layer. In such an MCP, heat generation during operation causes a decrease in resistance value of the MCP and an increase in output current, leading to a voltage drop at an output terminal. Such a decrease in output potential of the MCP causes an increase in gain of the MCP, leading to a loss of linearity of the MCP caused by DC voltage control (hereinafter referred to as "DC linearity"). On the other hand, a plurality of MCPs to be manufactured has an individual difference of resistance value. Accordingly, to fix an output potential of an MCP, an "individual difference of resistance value between CEMs" should be taken into consideration.

To solve the deterioration of DC linearity due to fluctuations in output potential of the MCP, for example, a power supply unit for setting an input potential of the MCP and a separate power supply unit for setting an output potential of the MCP may be prepared. Note that a configuration with a plurality of MCPs arranged in multiple stages via an electron lens requires preparation of a plurality of power supplies for each MCP. However, a voltage supply circuit, including such a plurality of power supply units, causes an increase in manufacturing cost of an ion detector in which a plurality of MCPs are arranged in multiple stages via an electron lens and makes it difficult to downsize the ion detector itself.

Accordingly, an ion detector according to a second embodiment has a configuration in which a target potential is set to a reference node which is not affected by fluctuations in an output potential (and/or an input potential) of an MCP so as to fix the target potential even at a section with a potential unfixed by a power supply unit. In particular, when fixing the target potential, it is not necessary to consider an individual difference of resistance value between a plurality of CEMs to be manufactured.

Figure 11:
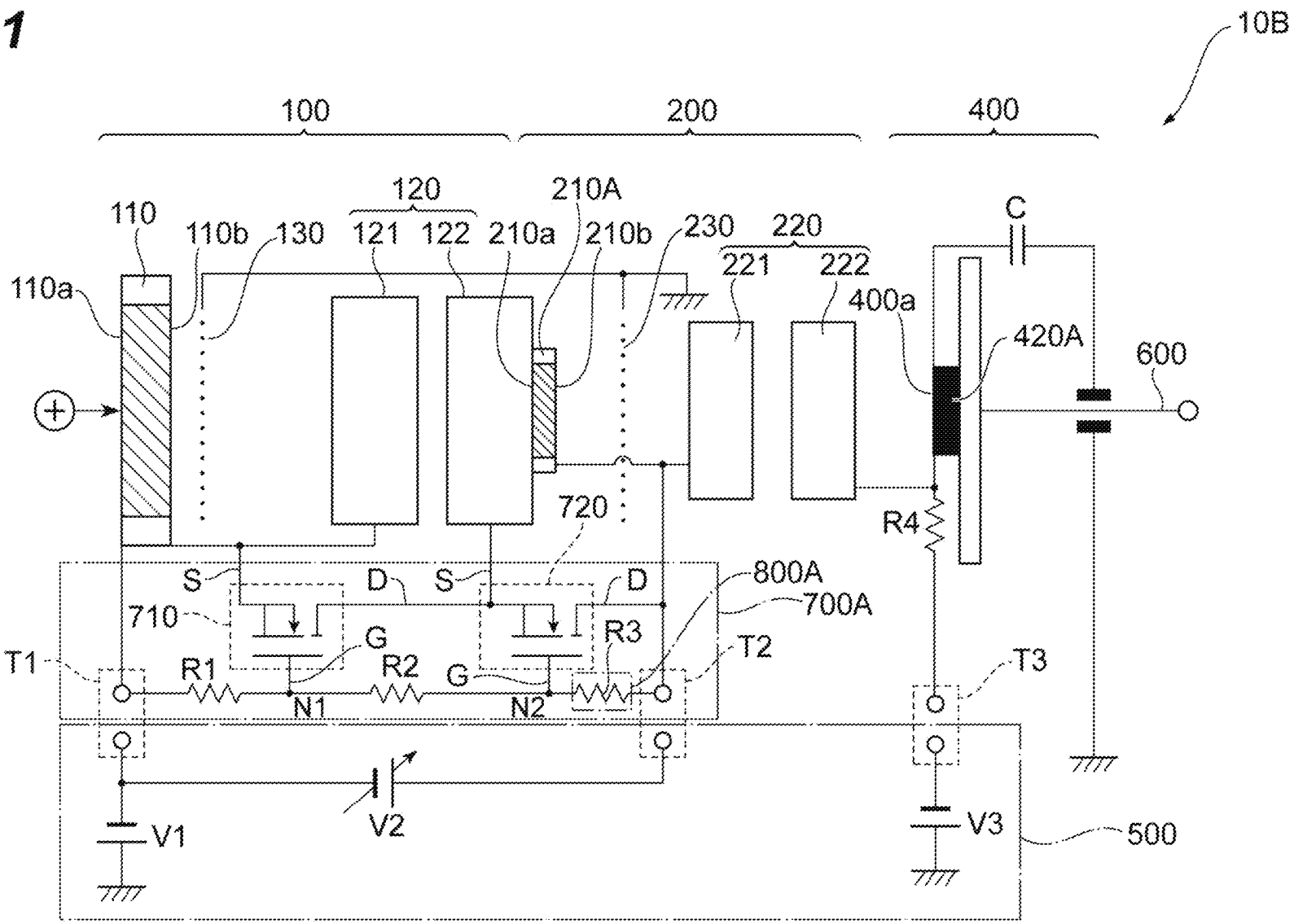
FIG. 11 is a view illustrating a configuration example of an ion detector according to a second embodiment.

FIG. 11 is a view illustrating a configuration example of an ion detector 10B according to the second embodiment. The ion detector 10B according to the second embodiment comprises a voltage supply circuit and a main section including an electrode structure. Note that the main section in the second embodiment has a structure similar to the main section in the first embodiment (FIG. 7). In other words, the main section in the second embodiment includes an MCP unit 100, a reset unit 200, and a detection unit 400.

The voltage supply circuit according to the second embodiment includes at least a power supply unit 500 and a constant voltage generator 700A. The power supply unit 500 includes a first power supply V1, a second power supply V2, and a third power supply V3. The first power supply V1 sets a potential of a first input surface 110*a* of an MCP 110 via a first terminal T1. The second power supply V2 ensures a predetermined potential difference between the first terminal T1 electrically connected to the first input surface 110*a* of the MCP 110 and a second terminal T2 electrically connected to a second output surface 210*b* of an intermediate MCP 210A. The third power supply V3 is connected to one terminal of an AD 420A via a third terminal T3. The first power supply V1 is disposed between a ground potential GND and the first terminal T1. In FIG. 11, for example, an electromotive force for setting a potential of the first terminal T1 to −7 kV is generated so as to capture positive ions at the first input surface 110*a* of the MCP 110. The second power supply V2 is a variable power supply disposed between the first terminal T1 and the second terminal T2 and generates an electromotive force to ensure a potential difference of, for example, about zero to 3.5 kV between the first input surface 110*a* of the MCP 110 and the second output surface 210*b* of the intermediate MCP 210A. The third power supply V3 is disposed between the ground potential GND and the third terminal T3 and generates an electromotive force for setting a potential of the third terminal T3 to, for example, −350 V.

The constant voltage generator 700A includes resistances R1 to R3 arranged in series between the first terminal T1 and the second terminal T2 and holds a first target potential of the first output surface 110*b* of the MCP 110 and a second target potential of the second input surface 210*a* of the intermediate MCP 210A. The first target potential is set to a first reference node N1 that is not affected by fluctuations in potential of the first output surface 110*b*. Furthermore, the second target potential is set to a second reference node N2 that is not affected by fluctuations in potential of the second input surface 210*a*. Specifically, a potential difference between the second terminal T2 and the first reference node N1 is ensured by a voltage drop of the resistance R2 and a voltage drop of a constant voltage supply 800A (including the resistance R3). A potential difference between the second terminal T2 and the second reference node N2 is ensured by a voltage drop of the constant voltage supply 800A including the resistance R3. A first potential fixing element 710 including an N-type MOS transistor (hereinafter referred to as "NMOS") is disposed between the first reference node N1 and the first output surface 110*b* of the MCP 110 that is unipotential with the first focus electrode 121. Furthermore, a second potential fixing element 720 including an NMOS is disposed between the second reference node N2 and the second input surface 210*a* of the intermediate MCP 210A that is unipotential with the other first focus electrode 122.

Note that a gate G of the first potential fixing element (NMOS) 710 is connected to the first reference node N1. A source S of the first potential fixing element 710 is connected to the first output surface 110*b* of the MCP 110 and one first focus electrode 121. A drain D of the first potential fixing element 710 is connected to a source S of the second potential fixing element 720. On the other hand, a gate G of the second potential fixing element (NMOS) 720 is connected to the second reference node N2. The source S of the second potential fixing element 720 is connected to the other first focus electrode 122 and the second input surface 210*a* of the intermediate MCP 210A while being connected to the drain D of the first potential fixing element 710. A drain D of the second potential fixing element 720 is connected to the second terminal T2.

In the second embodiment, during the electron multiplication, an increase of an output current (an increase of electrons emitted from the MCP 110 toward the intermediate MCP 210A) causes a voltage drop in the first output surface 110*b* of the MCP 110 and a voltage drop in the second input surface 210*a* of the intermediate MCP 210A. At this time, both a voltage $V_{GS}$ between the gate G and the source S of the first potential fixing element (NMOS) 710 and a voltage $V_{GS}$ between the gate G and the source S of the second potential fixing element (NMOS) 720 increase. When each $V_{GS}$ exceeds a threshold voltage, both the first potential fixing element 710 and the second potential fixing element 720 are turned on. When the NMOSs are in the ON state, electrons flow instantaneously from the first output surface 110*b* and the second input surface 210*a* toward the second terminal T2, which cancels the voltage drops in both the first output surface 110*b* of the MCP 110 and the second input surface 210*a* of the intermediate MCP 210A. The cancellation of the voltage drops decreases $V_{GS}$. Accordingly, both the first potential fixing element 710 and the second potential fixing element 720 are turned off. In other words, while a potential of the first output surface 110*b* is fixed to the first target potential of the first reference node N1, a potential of the second output surface 210*b* is fixed to the second target potential of the second reference node N2.

Third Embodiment

Figure 12:
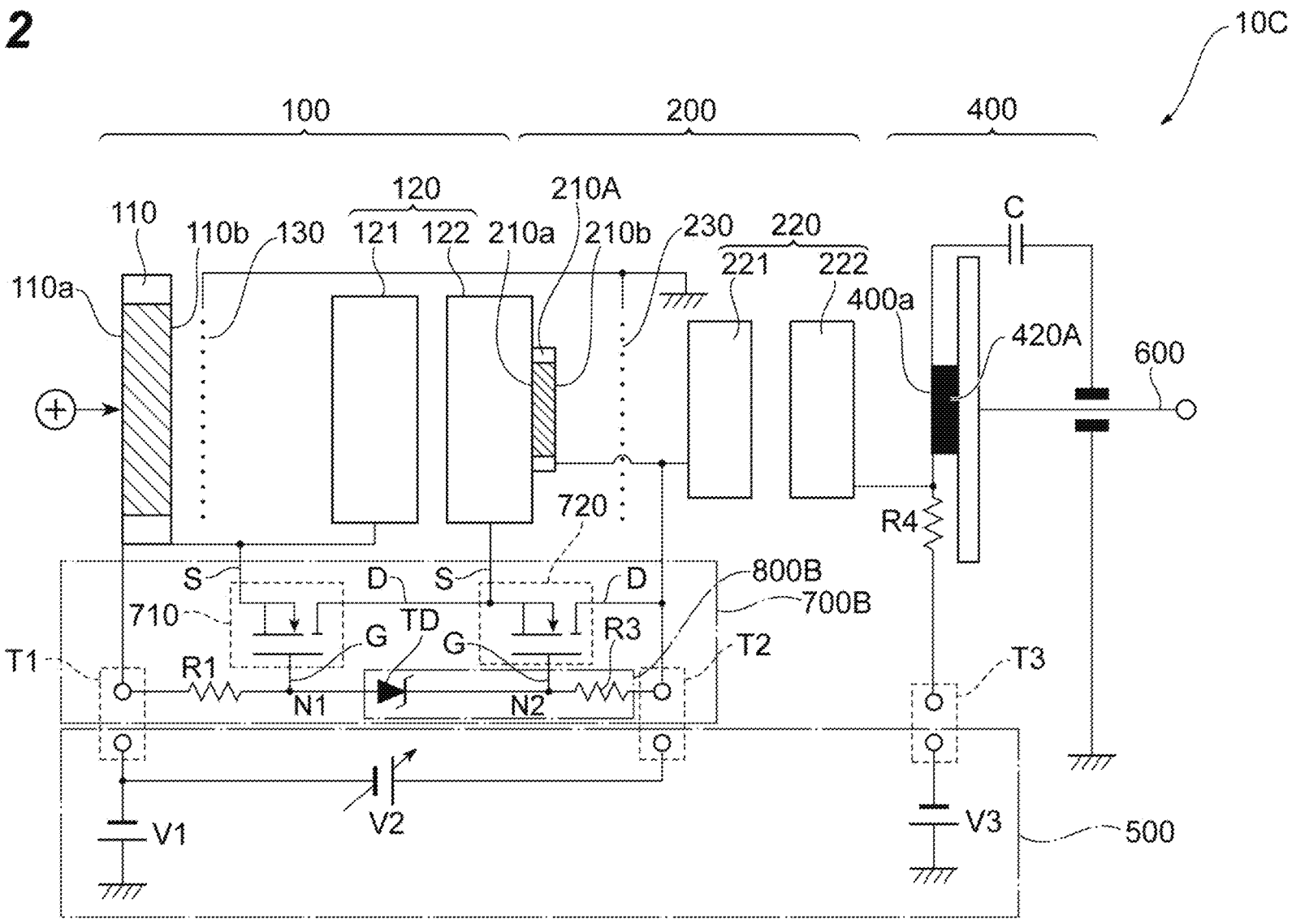
FIG. 12 is a view illustrating a configuration example of an ion detector according to a third embodiment.

FIG. 12 is a view illustrating a configuration example of an ion detector 10C according to a third embodiment. The ion detector 10C according to the third embodiment comprises a voltage supply circuit and a main section including an electrode structure. Note that the main section in the third embodiment has a structure similar to the main sections in the first embodiment (FIG. 7) and the second embodiment (FIG. 11). In other words, the main section in the third embodiment includes an MCP unit 100, a reset unit 200, and a detection unit 400.

The voltage supply circuit according to the third embodiment includes at least a power supply unit 500 and a constant voltage generator 700B. The power supply unit 500 has a configuration similar to that in the second embodiment (FIG. 11) in which positive ions are captured at the first input surface 110*a* of the MCP 110. However, in the constant voltage generator 700B, a Zener diode TD is disposed between a first reference node N1 and a second reference node N2, a potential difference between the first reference node N1 and the second reference node N2 is fixed, and the TD and a resistance R3 are included in a constant voltage supply 800B. Except for those points, a configuration and operation of the constant voltage generator 700B in the third embodiment are similar to the configuration and operation of the constant voltage generator 700A in the second embodiment.

Fourth Embodiment

Figure 13:
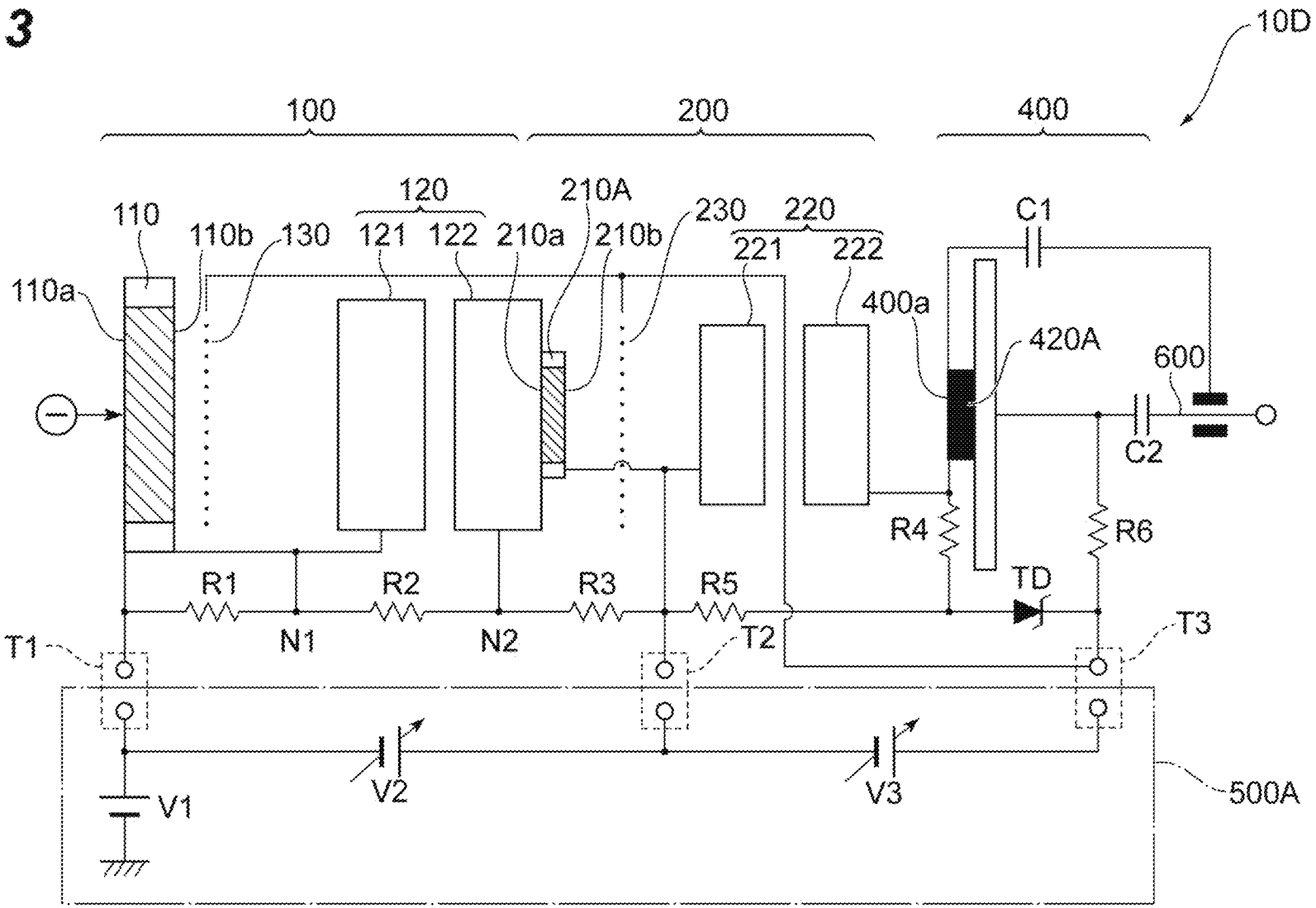
FIG. 13 is a view illustrating a configuration example of an ion detector according to a fourth embodiment.

FIG. 13 is a view illustrating a configuration example of an ion detector 10D according to a fourth embodiment. The ion detector 10D according to the fourth embodiment comprises a voltage supply circuit and a main section including an electrode structure. Note that the main section in the fourth embodiment includes an MCP unit 100, a reset unit 200, and a detection unit 400. The MCP unit 100 and the reset unit 200 in the fourth embodiment have a structure similar to those in the first to third embodiments (FIGS. 7, 11, and 12).

The detection unit 400 in the fourth embodiment comprises an AD 420A as a signal output device 420, and a mask member 410 defining an effective region A3 of an electron detector surface 400*a* of the AD 420A. The AD 420A is connected to the other second focus electrode 222 included in a part of an electron lens 220, and the AD 420A includes one terminal connected to a node at a predetermined potential via a resistance R4 and the other terminal connected to a signal output terminal via a capacitor C1. A signal amplified by the AD 420A is taken out from a signal line 600 via a capacitor C2. Furthermore, a node between the AD 420A and the capacitor C2 is connected to a third terminal T3 of a power supply unit 500A via a resistance R6. A Zener diode TD for fixing a potential difference is disposed between the third terminal T3 and the resistance R4.

The voltage supply circuit according to the fourth embodiment includes at least the power supply unit 500A and a constant voltage generator. The power supply unit 500A includes a first power supply V1, a second power supply V2, and a third power supply V3. The first power supply V1 sets a potential of a first input surface 110*a* of an MCP 110 via a first terminal T1. The second power supply V2 ensures a predetermined potential difference between the first terminal T1 electrically connected to the first input surface 110*a* of the MCP 110 and a second terminal T2 electrically connected to a second output surface 210*b* of an intermediate MCP 210A. The third power supply V3 ensures a predetermined potential difference between the second terminal T2 and the third terminal T3. The first power supply V1 is disposed between a ground potential GND and the first terminal T1. In FIG. 13, for example, an electromotive force for setting a potential of the first terminal T1 to +7 kV is generated so as to capture negative ions at the first input surface 110*a* of the MCP 110. The second power supply V2 is a variable power supply disposed between the first terminal T1 and the second terminal T2 and generates an electromotive force to ensure a potential difference of, for example, about zero to 3.5 kV between the first input surface 110*a* of the MCP 110 and the second output surface 210*b* of the intermediate MCP 210A. The third power supply V3 is disposed between the second terminal T2 and the third terminal T3 and generates an electromotive force to ensure a potential difference of, for example, about zero to 3.5 kV.

The constant voltage generator includes resistances R1 to R3 arranged in series between the first terminal T1 and the second terminal T2. The constant voltage generator is connected to a circuit in the detection unit 400 via a resistance R5. In other words, the resistance R5 has one end connected to the second terminal T2 and the other end electrically connected to the third terminal T3 via the Zener diode TD. The resistance R4 is disposed between one terminal of the AD 420A and a node between the resistance R5 and the Zener diode TD. Potentials of a first reference node N1 and a second reference node N2 are set based on a resistance ratio of the resistances R1 to R3 arranged in series between the first terminal T1 and the second terminal T2. For example, the resistance R1 is 3 MΩ, the resistance R2 is 10 MΩ, the resistance R3 is 2.7 MΩ, the resistance R4 is 1 kΩ, and the resistance R5 is 20 MΩ. In other words, the first reference node N1 between the resistance R1 and the resistance R2 is electrically connected to both the first output surface 110*b* of the MCP 110 and one first focus electrode 121. With such a circuit structure, the first reference node N1, the first output surface 110*b*, and the first focus electrode 121 are set to be unipotential. Furthermore, the second reference node N2 between the resistance R2 and the resistance R3 is electrically connected to both the other first focus electrode 122 and the second input surface 210*a* of the intermediate MCP 210A. With such a circuit structure, the second reference node N2, the first focus electrode 122, and the second input surface 210*a* are set to be unipotential.

It is clear from the description of the present invention that the present invention may employ various modifications. Such modifications are not allowed to depart from the spirit and scope of the invention, and modifications obvious to those skilled in the art are intended to be included in the scope of the following claims.

REFERENCE SIGNS LIST

10A to 10D . . . Ion detector; 100 . . . MCP unit; 110 . . . MCP; 110*a* . . . First input surface; 110*b* . . . First output surface; 121, 122 . . . First focus electrode (electron lens 120); 130 . . . First mesh electrode; 200 . . . Reset unit; 210*a* . . . Second input surface; 210*b* . . . Second output surface; 221, 222 . . . Second focus electrode (electron lens 220); 230 . . . Second mesh electrode; 300 . . . Auxiliary reset unit; 310*a* . . . Third input surface; 310*b* . . . Third output surface; 320 . . . Electron lens (third focus electrode); 400 . . . Detection unit; 400*a* . . . Electron detector surface;. 420 . . . Signal output device; 500, 500A . . . Power supply unit; 700A, 700B . . . Constant voltage generator; N1 . . . First reference node; N2 . . . Second reference node; T1 . . . First terminal; T2 . . . Second terminal; 710 . . . First potential fixing element; 720 . . . Second potential fixing element; and 800A, 800B . . . Constant voltage supply.

What is claimed is:

1. An ion detector comprising:

an MCP unit including an MCP and a first focus electrode, the MCP having a first input surface and a first output surface disposed so as to intersect with a predetermined reference axis while opposing each other, the first focus electrode facing the first output surface of the MCP and having a shape surrounding the reference axis, the MCP outputting an electron from the first output surface in response to an incident ion on the first input surface;

a signal output device including an electron detector surface intersecting with the reference axis; and a reset unit disposed between the MCP unit and the signal output device, wherein the reset unit includes:

a reset element having a second input surface and a second output surface disposed between the MCP unit and the signal output device so that the second input surface and the second output surface intersects with the reference axis while opposing each other, the reset element being arranged in such a manner that the second input surface faces the MCP unit and the second output surface faces the signal output device and being configured to reset, on the second output surface, variations in incident angle and velocity of the electron on the second input surface; and a second focus electrode disposed between the reset element and the signal output device and having a shape surrounding the reference axis.

2. The ion detector according to claim 1, wherein the reset element comprises an intermediate MCP having the second input surface and the second output surface, and the second input surface of the intermediate MCP has an area of an effective region smaller than an area of an effective region on the first input surface of the MCP.

3. The ion detector according to claim 1, wherein the reset element includes a channel electron multiplier having the second input surface, the second output surface, an electron input opening disposed on the second input surface, and an electron output opening disposed on the second output surface.

4. The ion detector according to claim 1, wherein the signal output device includes an electron impact diode having an electron capture surface serving as the electron detector surface.

5. The ion detector according to claim 1, wherein the signal output device includes:

a fluorescent material having a first surface serving as the electron detector surface and a second place opposing the first surface; and a photodetector disposed on an opposite side of the second focus electrode relative to the fluorescent material.

6. The ion detector according to claim 1, further comprising:

a first mesh electrode disposed between the MCP and the first focus electrode; and a second mesh electrode disposed between the reset element and the second focus electrode.

7. The ion detector according to claim 1, further comprising:

a voltage supply circuit which sets a potential of at least the first input surface of the MCP, the first output surface of the MCP, the second input surface of the reset element, and the second output surface of the reset element, wherein the voltage supply circuit includes:

a power supply unit which generates an electromotive force to ensure a potential difference between a first terminal electrically connected to the first input surface of the MCP and a second terminal electrically connected to the second output surface of the reset element; and a constant voltage generator which holds a first target potential for adjusting a potential of the first output surface of the MCP and a second target potential for adjusting a potential of the second input surface of the reset element, the constant voltage generator includes:

a first reference node disposed between the first terminal and the second terminal and being set to have the first target potential;

a first potential fixing element which eliminates a potential difference between the first output surface of the MCP and the first reference node;

a second reference node disposed between the first reference node and the second terminal and being set to have the second target potential;

a second potential fixing element which eliminates a potential difference between the second input surface of the reset element and the second reference node; and a constant voltage supply which causes a voltage drop to ensure a potential difference between at least the second terminal and the second reference node.

8. The ion detector according to claim 1, further comprising:

one or more auxiliary reset units disposed along the reference axis from the reset unit to the signal output device, wherein each of the auxiliary reset units includes:

an auxiliary reset element having a third input surface on a side closer to the MCP unit and a third output surface on a side closer to the signal output device, the auxiliary reset element resetting, on the third output surface, variations in incident angle and velocity of the electron on the third input surface; and a third focus electrode disposed on an opposite side of the third input surface relative to the third output surface and having a shape surrounding the reference axis.

* * * * *